US012091206B2

(12) United States Patent
Antonelli et al.

(10) Patent No.: US 12,091,206 B2
(45) Date of Patent: Sep. 17, 2024

(54) METHOD AND AN APPARATUS FOR PACKAGING ARTICLES

(71) Applicant: Fameccanica.Data S.p.A., San Giovanni Teatino (IT)

(72) Inventors: Gabriele Biagio Antonelli, San Giovanni Teatino (IT); Fabio Diodato, San Giovanni Teatino (IT)

(73) Assignee: Fameccanica.Data S.p.A., San Giovanni Teatino Chieti (IT)

( * ) Notice: Subject to any disclaimer, the term of this patent is extended or adjusted under 35 U.S.C. 154(b) by 0 days.

(21) Appl. No.: 17/836,420

(22) Filed: Jun. 9, 2022

(65) Prior Publication Data

US 2022/0396381 A1 Dec. 15, 2022

(30) Foreign Application Priority Data

Jun. 15, 2021 (EP) ..... 21179387

(51) Int. Cl.
*B65B 9/02* (2006.01)
*B65B 41/10* (2006.01)
*B65B 51/16* (2006.01)

(52) U.S. Cl.
CPC ..... *B65B 9/02* (2013.01); *B65B 41/10* (2013.01); *B65B 51/16* (2013.01)

(58) Field of Classification Search
CPC B65B 9/02; B65B 41/10; B65B 51/16; B65B 51/28
See application file for complete search history.

(56) References Cited

U.S. PATENT DOCUMENTS 2,374,504 A * 4/1945 Salfisberg ..... B65B 51/28 53/554
2,438,089 A * 3/1948 Carson ..... B65B 25/04 206/521.1
2,486,759 A * 11/1949 Pfeiffer ..... B65B 9/02 53/553
2,579,415 A * 12/1951 Carson ..... B65B 9/02 53/449
2,586,580 A * 2/1952 Truscott ..... B29C 66/003 53/553
2,871,639 A * 2/1959 Forgo ..... B65B 9/045 53/554
3,140,572 A * 7/1964 Petersen ..... B65B 9/02 53/553
3,751,875 A * 8/1973 Membrino ..... B65B 9/093 53/568
4,711,066 A * 12/1987 Fox ..... B65B 61/28 53/436

(Continued)

FOREIGN PATENT DOCUMENTS

DE 812416 C 8/1951
DE 1266681 B 4/1968

OTHER PUBLICATIONS

European Search Report dated Nov. 18, 2021. 4 pages.

*Primary Examiner* — Thomas M Wittenschlaeger
*Assistant Examiner* — Katie L Gerth
(74) *Attorney, Agent, or Firm* — RMCK Law Group PLC

(57) ABSTRACT

A method and apparatus for forming packages including articles enclosed between first and second continuous paper sheets having their edges joined by a thermally-activated adhesive, wherein the first and second continuous paper sheets are heated while subjected to a longitudinal tension.

15 Claims, 2 Drawing Sheets

(56) References Cited

U.S. PATENT DOCUMENTS 4,807,420 A * 2/1989 Barker ..... B65B 9/073 53/550
5,456,055 A * 10/1995 Boulanger ..... B29C 66/8432 53/374.4
5,740,661 A * 4/1998 Yamaguchi ..... B65B 9/02 53/553
5,875,614 A * 3/1999 Youngs ..... B29C 66/7294 53/DIG. 2
6,122,894 A * 9/2000 Romagnoli ..... B65B 9/02 53/64
6,534,132 B1 * 3/2003 Lasson ..... B41M 7/0027 427/361
6,647,702 B1 * 11/2003 Kim ..... B65B 5/103 53/550
6,979,482 B2 * 12/2005 Hartzell ..... B65D 31/02 428/34.3
7,302,781 B2 * 12/2007 Michler ..... B65B 25/14 53/399
10,414,123 B2 * 9/2019 Bonelli ..... B29C 65/086
2001/0051235 A1 * 12/2001 Otsu ..... A45D 40/0087 428/34.1
2007/0214749 A1 * 9/2007 Micnerski ..... B65B 43/06 53/558
2008/0047658 A1 * 2/2008 von-Vajna ..... B29C 66/1122 156/196
2009/0120828 A1 * 5/2009 Sanfilippo ..... B31B 50/81 206/508
2009/0321283 A1 * 12/2009 Tourigny ..... B65D 75/366 53/461
2011/0083810 A1 * 4/2011 Lin ..... B65B 61/184 156/497
2012/0114810 A1 * 5/2012 Demaurex ..... B65B 9/20 426/119
2017/0095586 A1 * 4/2017 Loebertmann ..... B65B 41/10
2018/0178938 A1 * 6/2018 Zhao ..... B65B 9/2028
2019/0084710 A1 * 3/2019 Wolf ..... B65B 51/16
2020/0108960 A1 * 4/2020 Shimoda ..... B65H 19/1852
2023/0049174 A1 * 2/2023 Johnson ..... A61B 10/0045

* cited by examiner

METHOD AND AN APPARATUS FOR PACKAGING ARTICLES

CROSS-REFERENCE TO RELATED APPLICATION

This application claims priority to European Patent Application No. 21179387.2 filed Jun. 15, 2021. The disclosure of the above application is incorporated herein by reference in its entirety.

FIELD OF THE INVENTION

The present invention relates in general to the packaging of articles, in particular of flat articles, i.e. articles having a thickness lower than the other dimensions.

More precisely, the invention relates to a method and an apparatus for forming packages comprising articles enclosed between two opposite paper sheets having their edges joined by a thermally-activated adhesive.

The invention was developed, in particular, with a view to its application in the field of packaging plasters, such as, for example, plasters for covering wounds, medicated plasters, pain-relieving plasters, heating plasters with and without medicaments.

In the following description, reference will be made to this specific field without however losing generality.

DESCRIPTION OF THE PRIOR ART

In the medical field there are different types of plasters. In many cases, these products are boxed without being wrapped. In some cases, the plasters are packaged individually in envelope-shaped packages before being boxed.

Individual packaging of the plasters is carried out by enclosing the individual plasters between two flexible sheets overlapping each other that enclose a respective plaster like a sandwich, and are joined together at their edges by means of adhesive. Typically, in this field the adhesive used is a thermally-activated adhesive because it guarantees stable fixing of the sheets so that the articles are protected from external agents. Thanks to these thermally-activated adhesives, once the package is opened, it is no longer resealable, and this allows the health and hygiene standards relating to the marketing of plasters or other similar articles to be met. The packages may be formed by two sheets of paper, one of which has an inner surface on which a thermally-activated adhesive is applied. The sheet provided with the thermally-activated adhesive may be a layered material already provided with an adhesive.

In apparatus according to the prior art, the packaging of the plasters between two flexible sheets is carried out by advancing a continuous array of plasters along a machine direction, spaced apart from each other, and two continuous paper sheets overlapping each other on opposite sides of the continuous array of plasters, one of which has a layer of thermally-activated adhesive, so as to form a continuous composite tape consisting of the two continuous paper sheets and the continuous array of plasters sandwiched between the two continuous paper sheets. The packages are closed by passing the continuous composite tape through at least one pair of pressure rollers.

The fixing between the two paper sheets takes place by activating the thermally-activated adhesive, which occurs while the flexible sheets are compressed together along the compression lines.

Subsequently, the packages are obtained by transversally cutting the continuous composite tape along the transverse welds between each pair of articles.

The welding between the two paper sheets must meet precise quality requirements defined by the plaster manufacturers. The quality specifications are as follows:

- from the point of view of visual appearance: there must be a clear transfer of the adhesive material from one sheet to another, the welding joint must be complete and clean, without impurities and without apparent damage, the color of the packaging sheets must not change due to the welding process, and the packaging sheets must not be noticeably deformed due to the welding process;
- from the point of view of the sealing of the weld: the release force (peeling) must be within a precise quantified range, and during opening of the package there must be no variations in the release force between one area and the other, or between different packages;
- from the point of view of sealing of the weld and of the hygiene-sanitary standards: welding of the package must be such that the product is in an environment wherein any contaminants cannot access from the outside of the package, and also such as to guarantee the absence of leakage of substances from the inside (a leak test is performed by placing a colored liquid inside a package and monitoring for any spills).

One of the main problems of the apparatus according to the prior art is that the current maximum speed of the packaging equipment is in the order of 50-60 m/min. This speed limit is due to the fact that as the speed of the machine increases, the pressure rollers are unable to give the flexible sheets sufficient energy to allow the correct transfer of the adhesive material from one sheet to another because the contact time is proportionally reduced between the pressure rollers and the sheets. In this context, increasing the speed of the apparatus beyond the limit of 50-60 m/min would compromise the quality requirements prescribed by the plaster manufacturers.

U.S. Pat. No. 5,613,601A discloses a method and apparatus for heat-sealing dispensing packages comprising a water permeable bag formed by two non-woven webs which enclose predetermined quantities of a particulate product, such as tea or coffee that releases a flavoring substance in steeping liquid. The non-woven webs have a thermally activated bonding surface permitting to permanently close the bag by peripherally heat-sealing the bag walls to one another. The heat-sealing operation is performed simultaneously with enclosing the predetermined quantity of particulate product between the two non-woven webs.

OBJECT AND SUMMARY OF THE INVENTION

The object of the present invention is to provide a method and an apparatus for packaging articles enclosed between two opposite flexible sheets, joined together by a thermally-activated adhesive, which allow the production speed to be increased without compromising the quality requirements of the packages.

According to the present invention, this object is achieved by a method and by an apparatus having the characteristics forming the subject of claims 1 and 10.

BRIEF DESCRIPTION OF THE DRAWINGS

The present invention will now be described in detail with reference to the attached drawings, given purely by way of non-limiting example, wherein.

DETAILED DESCRIPTION

Figure 1:
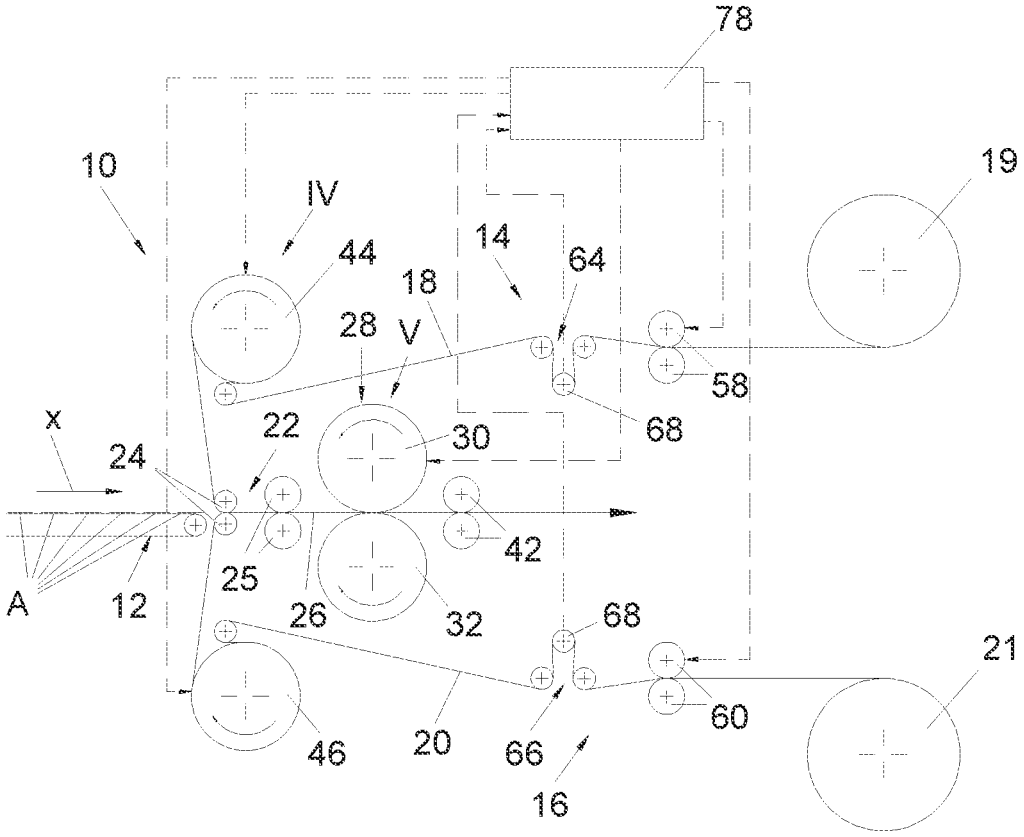
FIG. 1 is a schematic view of an apparatus for packaging articles according to the present invention.

With reference to FIG. 1, reference 10 indicates an apparatus for packaging flat articles A in envelope-shaped packages closed around each article A along the edges of the packages.

The articles A may be wound-covering plasters, medicated plasters, pain-relief plasters, heating plasters, and the like.

The articles A are aligned and spaced apart from each other in a continuous array that advances in a machine direction X on an inlet conveyor 12.

The apparatus 10 comprises a first feeding assembly 14 and a second feeding assembly 16 that feed, respectively, a first continuous paper sheet 18 and a second continuous paper sheet 20 towards an overlapping unit 22.

The first and second continuous paper sheet 18, 20 are unwound from respective reels 19, 21. At least one of the two continuous paper sheets 18, 20 comprises a thermally-activated adhesive. One of the two continuous paper sheets 18, 20 may be a layered material already equipped with a thermally-activated adhesive. In other embodiments, the thermally-activated adhesive may be applied in-line using an adhesive dispenser. The thermally-activated adhesive layer may be applied or already present on the entire surface of the continuous paper sheet 18, 20. The thermally-activated adhesive has no adhesive characteristics until it is heated above a preset temperature (activation temperature) for a preset time. After applying pressure, the thermally-activated adhesive fixes its state and, typically, even if heated again to the activation temperature, it no longer changes its state.

In a possible embodiment, the first continuous paper sheet 18 may have a specific weight of 8.3 g/m$^2$ and may have a layer of thermally-activated adhesive over an entire surface, and the second continuous paper sheet 20 may have a specific weight of 9 g/m$^2$ and may have on a surface a layer of silicone-like smooth material. The two continuous paper sheets 18, 20 are coupled so that the surface with the thermally-activated adhesive of the first continuous paper sheet 18 comes into contact with the smooth surface of the second continuous paper sheet 20.

The overlapping unit 22 may comprise a pair of coupling rollers 24 tangential to each other and rotatable in opposite directions around respective axes parallel to each other and perpendicular to the machine direction X. The coupling rollers 24 may be idle around the respective axis of rotation.

The two continuous paper sheets 18, 20 are kept in contact with the outer surfaces of the respective coupling rollers 24 while they advance towards the tangency area of the two coupling rollers 24. The articles A are fed in the direction X between the two continuous paper sheets 18, 20 towards the tangency area between the pair of coupling rollers 24. The two continuous paper sheets 18, 20 are overlapped to each other on opposite sides with respect to the articles A while passing through the tangency area of the pair of coupling rollers 24.

Downstream of the overlapping unit 22, a continuous composite tape 26 is formed, comprising two continuous paper sheets 18, 20 overlapped to each other, and a continuous array of articles A spaced apart longitudinally from each other and sandwiched between the two continuous paper sheets 18, 20. One of the two continuous paper sheets 18, 20 has a layer of thermally-activated adhesive arranged on its surface facing the other continuous paper sheets 18, 20.

The apparatus 10 comprises a compression unit 28 configured to fix to each other the two continuous paper sheets 18, 20 by compressing the thermally-activated adhesive along sealing lines that extend around individual articles A.

The overlapping unit 22 and the compression unit 28 are two separate modules independent of each other, so that the steps of overlapping and compressing the two continuous flexible sheets 18, 20 are separate. In particular, the compression step is carried out when the step of enclosing the articles A between the flexible sheets 18, 20 is completed, so that the articles are completely enclosed between the flexible sheets 18, 20 when the compression step is carried out.

Figure 4:
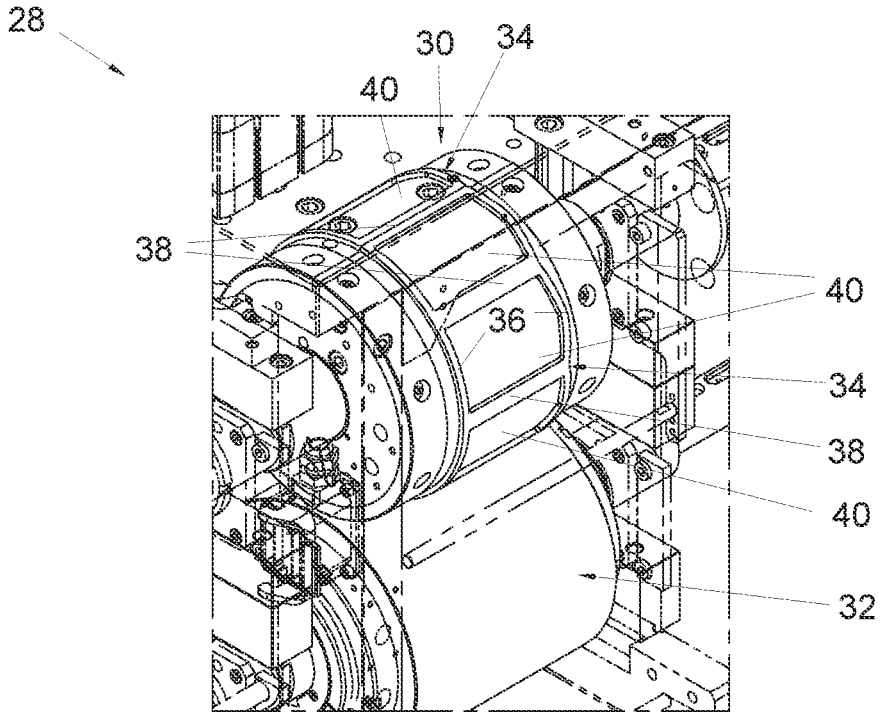
FIG. 4 is a partial perspective view of a heating roller indicated by the arrow IV in FIG. 1.

With reference to FIG. 4, the compression unit 28 comprises a first and a second mutually cooperating compression rollers 30, 32, which are configured to compress the continuous composite tape 26 along a series of compression areas 34, each having a frame-like shape which surround respective articles A. The compression areas 34 are formed on the peripheral surface of the first compression roller 30. The compression areas 34 may be defined by two continuous longitudinal compression elements 36 and by a plurality of transversal compression elements 38. The compression areas 34 may be made of soft material, e.g. by silicone, in order to avoid the formation of markings on the two continuous paper sheets 18, 20. In a possible embodiment the first compression roller 30 is not heated, and the second compression roller 32 may be heated, e.g. by inner heating resistors.

The second compression roller 32 may have a smooth outer surface pressed against the longitudinal compression elements 36 and the transversal compression elements 38 of the first compression roller 30.

With reference to FIG. 1, a first pair of feeding rollers 25 may be arranged between the coupling rollers 22 and the compression rollers 30, 32 and a second pair of feeding rollers 42 may be arranged downstream of the compression rollers 30, 32. The first and second pair of feeding rollers 25, 42 are driven at the same peripheral speed and have the purpose of controlling the feeding speed of the continuous composite tape 26 as it passes through the compression unit 28. The first and second pair of feeding rollers 25, 42 may have recessed central portions to avoid compressing the articles A.

With reference to FIG. 1, the apparatus 10 comprises a first and a second heating roller 44, 46, configured for heating the respective continuous paper sheets 18, 20 upstream of the overlapping unit 22.

Figure 5:
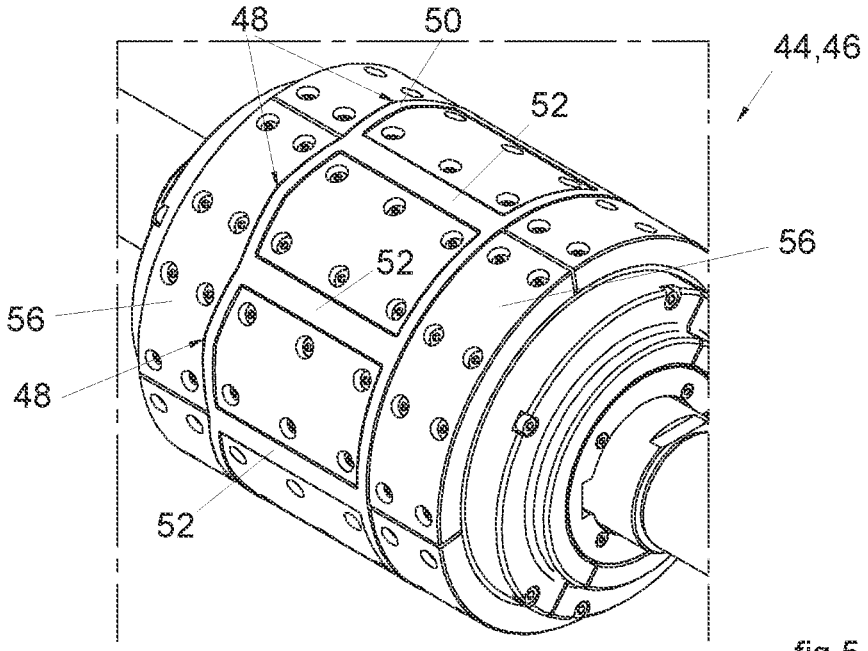
FIG. 5 is a perspective view of a compression unit indicated by the arrow V in FIG. 1.

With reference to FIG. 5, each heating roller 44, 46 may be configured to heat the respective first or second continuous paper sheet 18, 20 along localized heating areas 48, each having a frame-like shape, formed on the outer surface of the heating roller 44, 46. In a possible embodiment, the heating areas 48 have the same shape as the compression areas 34. Each of the heating roller 46, 48 may have the same structure as the compression roller 30 of the compression unit 28. Similarly to the compression areas 34, the heating areas 48 may be defined by two continuous longitudinal heating elements 50 and by a plurality of transversal heating elements 52, which may be made of metal, e.g. by steel. Each heating area 48 surrounds an insulating portion 54 formed by a thermally insulating material, e.g. Teflon© or Ultem©. Portions 56 of thermally insulating material may also be arranged laterally outwardly to the longitudinal heating elements 52.

The heating areas 48 of the heating rollers 44, 46 may be heated by heating elements arranged inside the heating rollers 44, 46. The heating elements may be electrical heating elements or fluid heating elements using a fluid, for example oil or air, as a heating medium.

With reference to FIG. 1, the first and second feeding assemblies 14, 16 feed the respective first and second continuous paper sheet 18, 20 on the outer surfaces of the respective heating rollers 44, 46. The first and second continuous paper sheet 18, 20 are wound on the outer surfaces of the respective heating rollers 44, 46 with an angular extension of about 280°. The wounding angle of the first and second continuous paper sheet 18, 20 on the outer surfaces of the respective heating rollers 44, 46 depends on the diameter of the heating rollers 44, 46 and on the feeding speed of the first and second continuous paper sheet 18, 20. With a feeding speed of the first and second continuous paper sheet 18, 20 of about 200 m/min the first and second continuous paper sheet 18, 20 should remain in contact with the outer surfaces of the respective heating rollers 44, 46 along respective arcs having an extension of 800-1000 mm. With a feeding speed of the first and second continuous paper sheet 18, 20 of about 100 m/min it is sufficient that the first and second continuous paper sheet 18, 20 remain in contact with the outer surfaces of the respective heating rollers 44, 46 along respective arcs having an extension of about 505 mm.

The heating rollers 44, 46 may be configured to heat the continuous paper sheets 18, 20 along the heating areas 48 at a temperature comprised between 100-200° C., preferably between 160-180° C.

Heating of the first and second continuous paper sheet 18, 20 on the first and second heating roller 44, 46 may not completely activate the thermally-activated adhesive, so that the first and second continuous paper sheet 18, 20 are not glued to each other in the overlapping unit 22. In this case, full activation of the thermally-activated adhesive is carried out in the compression unit 28. In possible embodiments, heating of the continuous paper sheets 18, 20 on the heating rollers 44, 46 may fully activate the thermally-activated adhesive, so that the thermally-activated adhesive is fully activated before reaching the compression unit 28.

The pressure roller 30 of the compression unit 28, and the heating rollers 44, 46 are controlled by an electronic control unit 78, which drives the heating rollers 44, 46 and the compression roller 30 around the respective axes at the same speed and maintains the heating areas 48 and the compression areas 34 in phase with each other, so that the continuous composite tape 26 is compressed in compression areas 34 overlapped to heating areas 48 of the first and second continuous paper sheet 18, 20.

The preliminary heating of the continuous flexible sheets 18, 20 on the heating rollers 44, 46 allows a much greater speed of the continuous composite tape during the passage through the compression unit 28. It has been found that by heating the continuous flexible sheets 18, 20 to temperatures in the order of 160-180° C., it is possible to advance the continuous composite tape 26 through the compression unit 28 at speeds in the order of 200 m/min. The flexible sheets 18, 20 may advance through the compression unit 28 at a speed of 150-250 m/min, in particular 180-210 m/min. The preliminary heating ensures that, even with very high manufacturing speeds, the resulting packages meet all the quality requirements defined by the plaster manufacturers, in particular, uniform transfer of the thermally-activated adhesive to the sheet without the adhesive layer, optimal sealing of the weld, a uniform release force and the guarantee of absence of leaks.

In accordance with a feature of the present invention, the first and second feeding assembly 14, 16 are configured for feeding the first and second continuous paper sheet 18, along respective longitudinal directions with a longitudinal tension comprised between 50 and 200 N. An optimal tension is about 100 N. This tension is maintained in the path of the first and second continuous paper sheet 18, 20 extending from the respective feeding assembly 14, 16 up to the compression unit 28. In a possible embodiment the tension of the first and second continuous paper sheet 18, 20 is maintained up to the second pair of feeding rollers arranged downstream of the compression unit 28.

In prior art solutions, the typical working tension of the continuous paper sheets is usually in a range comprised from a few N up to 20-30 N. It has been found that with feeding speed of the continuous paper sheets of about 200 m/l' with the tension used in the prior art methods there is a poor glue transfer at the center of the transversal sealing portions. It has also been found that as the tension of the first and second continuous paper sheet 18, 20 at the heating rollers 44, 46 increases, the sealing quality between the first and second continuous paper sheet 18, 20 at the center of the transversal sealing portions improves.

The reason for an improved sealing quality as the tension increases is that a high tension of the continuous paper sheets 18, 20 on the heating rollers 44, 46 ensures a more uniform contact of the paper sheets on the heating rollers 44, 46 in a transversal direction.

It has been found that by gradually increasing the feeding tension of the continuous paper sheets 18, 20 the problem of a reduced sealing connection at the center of the transversal seal is progressively reduced.

Tests carried out by the Applicant showed that a feeding tension of the continuous paper sheets 18, 20 of about 100 N eliminated defects in the central part of the transverse seal.

The sealing quality at the center of the transverse seal can further increase with higher feeding tensions. The upper limit of the feeding tension can be close to the breaking limit of the paper sheets (about 200 N for the paper sheet having the layer of thermally-activated adhesive and about 150 N for the paper sheet without the layer of thermally-activated adhesive). The lower limit of the feeding tensions is in the range of 50-60 N. It should be noted that these tension values are very different from the feeding tensions of non-woven webs, which usually are comprised in the range of 1-10 N. High feeding tensions in the solution according to the present invention are possible because paper is a material having very small deformability, which can be subjected to tensions close to the braking limit with small stretching.

Various methods are possible for tensioning the first and second continuous paper sheet 18, 20 while they pass in contact with the heating rollers 44, 46.

With reference to FIG. 1, in a possible embodiment, the first and second feeding assembly 14, 16 may comprise respective feeding rollers 60, 58 which may be driven with a peripheral speed lower than the peripheral speed of the feeding rollers 25, 42.

In a possible embodiment, the heating rollers 44, 46, the feeding rollers 25, 42 and the compression rollers 30, 32 are all driven at the same peripheral speed, so that the longitudinal tensions of the first and second continuous paper sheet 18, 20 are kept constant in the respective paths extending from the heating rollers 44, 46 up to the feeding rollers 42 located downstream of the compression rollers 30, 32. In certain conditions, the peripheral speed of the compression rollers 30, 32 and of the heating rollers 44, 46 may be slightly different from the peripheral speed of the feeding rollers 25, 42. In these conditions there is a slight slipping between the first and second continuous paper sheet 18, 20 and the compression rollers 30, 32 and heating rollers 44 *e* 46.

The electronic control unit 78 may control the peripheral speed of the feeding rollers 60, 58 on the basis of signals provided by tension measuring devices 64, 66 which measure the longitudinal tension of the respective first and second continuous paper sheet 18, 20. Each tension measuring devices 64, 66 may comprise a load cell 68 formed by an idle roller on which the first or second continuous paper sheet 18, 22 is wound. The load cells 68 send to the electronic control unit 78 signals indicating the longitudinal tensions of the first and second continuous paper sheet 18, 22. If, for any reason, the longitudinal tension of the first and second continuous paper sheet 18, 20 varies with respect to the preset value, the electronic control unit 78 varies the speed of the feeding rollers 58, 60 to keep the tension of the first and second continuous paper sheet 18, 22 at the preset value.

Figure 2:
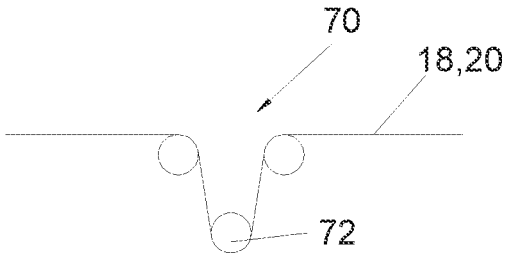
FIGS. 2 and 3 are schematic details of possible embodiments of tensioning devices for an apparatus according to the present invention.

With reference to FIG. 2, in a possible embodiment each of the first and second feeding assembly 14, 16 may comprise a tensioning device 70 which applies a transversal force on the respective first or second continuous paper sheet 18, 20 as it moves towards the respective heating roller 44, 46. The tensioning device 70 may comprise a tensioning roller 72 cooperating with the respective continuous paper sheet 18, 20 and movable in a direction transversal to the respective continuous paper sheet 18, 20.

The tensioning roller 72 may be carried by a pivoting arm articulated about an axis parallel to the axis of rotation of the tensioning roller 72. A weight may be provided on the pivoting arm to adjust the force applied by the tensioning roller 72 to the respective continuous paper sheet 18, 20.

Figure 3:
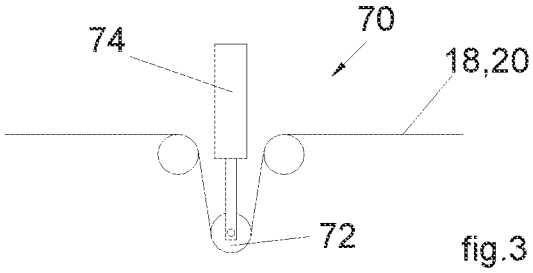

With reference to FIG. 3, in a possible embodiment the tensioning device 70 may comprise an actuator 74 which moves the tensioning roller 72 transversally to the respective continuous paper sheet 18, 20.

The longitudinal tension of the first and second continuous paper sheet 18, 20 is equal to half of the force applied by the tensioning roller 74 to the respective continuous paper sheet 18, 20.

Feeding the first and second continuous paper sheet 18, 20 with high longitudinal tensions solves the problem of a poor sealing quality at high speeds but introduces a problem when the apparatus is stopped. If the paper sheets 18, 20 remain stationary in contact with the heating rollers 44, 46 under a high longitudinal tension for a certain time (about 30 minutes) they can burn or be damaged to such an extent that they may break when the apparatus is restarted. In order to solve this problem, the first and second feeding unit 14, 16 are configured for reducing the longitudinal tension of the respective first and second continuous paper sheet 18, 20 when feeding of the first and second continuous paper sheet 18, 20 is stopped. When the apparatus is stopped the longitudinal tension of the respective first and second continuous paper sheet 18, 20 may be reduced to 0-30 N. In the embodiment of FIG. 1, the reduction of the longitudinal tension of the first and second continuous paper sheet 18, 20 may be obtained by increasing the speed of the feeding rollers 58, 60 just before stopping the apparatus 10 or by driving for a short time the feeding rollers 58, 60 after the apparatus 10 is stopped.

In the embodiment of FIGS. 2 and 3 the reduction of the longitudinal tension of the first and second continuous paper sheet 18, 20 may be obtained by raising the tensioning roller 72, so as to reduce or eliminate the force applied by the tensioning roller 72 to the first and second continuous paper sheet 18, 20.

Of course, without prejudice to the principle of the invention, the details of construction and the embodiments can be widely varied with respect to those described and illustrated, without thereby departing from the scope of the invention as defined by the claims that follow.

The invention claimed is:

1. A method for packaging articles comprising:

feeding in respective longitudinal directions first and second continuous paper sheets, at least one of which has a thermally-activated adhesive on one surface, tensioning said first and second continuous paper sheets along the respective longitudinal directions with a longitudinal tension comprised between 50 N and 200 N to improve retention of the thermally-activated adhesive, heating said first and second continuous paper sheets on respective heating rollers while tensioned in the longitudinal directions so as to heat the first and second continuous paper sheets while not activating the thermally-activated adhesive such that the heated first and second continuous paper sheets are not bonded to each other when overlapped, feeding a flow of articles between said first and second continuous paper sheets, overlapping the heated and tensioned first and second continuous paper sheets on opposite sides of said flow of articles via respective overlapping rollers separate from the heating rollers, wherein said first and second continuous paper sheets are not bonded to each other during said overlapping, and compressing and further heating said first and second continuous paper sheets around articles of said flow of articles to activate the thermally-activated adhesive for bonding and fix to each other said first and second continuous paper sheets by said thermally-activated adhesive, said compressing and further heating being carried out by a single pair of mutually cooperating compression rollers, which are separate from the heating rollers and the overlapping rollers.

2. The method of claim 1, wherein said first and second continuous paper sheets are kept tensioned from upstream of said respective heating rollers up to said compressing step.

3. The method of claim 1, wherein said first and second continuous paper sheets are tensioned by controlling respective feeding speeds upstream of said respective heating rollers.

4. The method of claim 3, comprising measuring the longitudinal tension of the first and second continuous paper sheets and controlling said respective feeding speeds on a basis of the measured tensions.

5. The method of claim 1, wherein said first and second continuous paper sheets are tensioned by applying to said first and second continuous paper sheets a transversal tensioning force by a respective tensioning roller.

6. The method of claim 1, wherein said longitudinal tension is reduced when feeding of said first and second continuous paper sheets is stopped.

7. The method of claim 1, wherein said first and second continuous paper sheets are heated along heating areas each having a frame-like shape.

8. The method of claim 7, wherein said first and second continuous paper sheets are compressed along compression areas surrounding respective articles, each having a frame-like shape and overlapped to respective heating areas.

9. The method of claim 7, wherein during said compression step, said first and second continuous paper sheets are heated along said compression areas.

10. An apparatus for packaging articles comprising:

first and second feeding assemblies configured for feeding in respective longitudinal directions first and second continuous paper sheets at least one of which has a thermally-activated adhesive on one surface, the first and second feeding assemblies being configured for feeding said first and second continuous paper sheets with a longitudinal tension comprised between 50 N and 200 N to improve retention of the thermally-activated adhesive, first and second heating rollers configured for heating said first and second continuous paper sheets while tensioned in the respective longitudinal directions so as to heat the first and second continuous paper sheets while not activating the thermally-activated adhesive for bonding of the first and second continuous paper sheets to each other, an inlet conveyor configured for feeding a flow of articles between said first and second continuous paper sheets, an overlapping unit configured for overlapping to each other the heated and tensioned first and second continuous paper sheets on opposite sides of said flow of articles via respective overlapping rollers of the overlapping unit, said overlapping rollers being separate from the first and second heating rollers, wherein said first and second continuous paper sheets are not bonded to each other during said overlapping, and a compression unit configured for compressing and further heating said first and second continuous paper sheets around articles of said flow of articles to activate the thermally-activated adhesive for bonding and fix to each other said first and second continuous paper sheets by said thermally-activated adhesive, said compressing and further heating being carried out by a single pair of mutually cooperating compression rollers, which are separate from the first and second heating rollers and the overlapping rollers.

11. The apparatus of claim 10, wherein said first and second feeding assemblies are configured for controlling the longitudinal tension of the first and second continuous paper sheets by controlling respective feeding speeds.

12. The apparatus of claim 10, wherein said first and second feeding assemblies comprise respective tensioning rollers configured for applying a transversal tensioning force to the respective first and second continuous paper sheets.

13. The apparatus of claim 10, wherein said first and second feeding assemblies are configured for reducing the longitudinal tension of said first and second continuous paper sheets when feeding of said first and second continuous paper sheets is stopped.

14. The apparatus of claim 10, wherein each of said first and second heating rollers has a plurality of heating areas each having a frame-like shape, surrounded by thermally insulating material.

15. The apparatus of claim 14, wherein said compression unit comprises a compression roller having a plurality of compression areas each having a frame-like shape in phase with said heating areas of said first and second heating rollers.

* * * * *